US011505447B2

(12) United States Patent
Boutelje et al.

(10) Patent No.: US 11,505,447 B2
(45) Date of Patent: Nov. 22, 2022

(54) ROTATIONAL HOUSING FOR AN RFID TAG ON A FUEL NOZZLE

(71) Applicant: ASSA ABLOY AB, Stockholm (SE)

(72) Inventors: Adrian Boutelje, Westmead (ZA); Scot Cowley, Durban (ZA); Albertus Louis Koen, Durban (ZA)

(73) Assignee: ASSA ABLOY AB, Stockholm (SE)

( * ) Notice: Subject to any disclaimer, the term of this patent is extended or adjusted under 35 U.S.C. 154(b) by 156 days.

(21) Appl. No.: 16/765,612

(22) PCT Filed: Nov. 28, 2017

(86) PCT No.: PCT/IB2017/057428
§ 371 (c)(1),
(2) Date: May 20, 2020

(87) PCT Pub. No.: WO2019/106405
PCT Pub. Date: Jun. 6, 2019

(65) Prior Publication Data
US 2020/0299125 A1 Sep. 24, 2020

(51) Int. Cl.
*B67D 7/14* (2010.01)
*B67D 7/34* (2010.01)
*B67D 7/42* (2010.01)

(52) U.S. Cl.
CPC ..... *B67D 7/348* (2013.01); *B67D 7/145* (2013.01); *B67D 7/425* (2013.01)

(58) Field of Classification Search
CPC ..... B67D 7/348; B67D 7/145; B67D 7/425
See application file for complete search history.

(56) References Cited

U.S. PATENT DOCUMENTS

2016/0012261 A1* 1/2016 Kelrich ..... G06K 7/10198 340/10.51
2018/0229995 A1* 8/2018 Piccione ..... B67D 7/04

FOREIGN PATENT DOCUMENTS

| | | | |
|---|---|---|---|
| DE | 102005002245 | A1 | 7/2006 |
| EP | 2193950 | A2 | 6/2010 |
| EP | 2778116 | A1 | 9/2014 |
| GB | 2400364 | A | 10/2004 |
| WO | WO-2008090539 | A2 | 7/2008 |
| WO | WO-2008096361 | A2 | 8/2008 |
| WO | WO-2019106405 | A1 | 6/2019 |

OTHER PUBLICATIONS

"International Application Serial No. PCT/IB2017/057428, International Search Report dated Jul. 18, 2018", 5 pgs.

(Continued)

*Primary Examiner* — Jason K Niesz
(74) *Attorney, Agent, or Firm* — Schwegman Lundberg & Woessner, P.A.

(57) ABSTRACT

A repositionable radio frequency identification housing (18) for a fuel delivery nozzle (10) is disclosed. The RFID housing (18) is affixed to and is repositionable relative to the fuel delivery nozzle (10). A RFID reader is positioned within the housing (18) for communicating with a radio frequency identification tag associated with a vehicle. The RFID housing (18) is repositionable to accommodate vehicles of different physical geometries and to enhance wireless communication with the RFID tag.

20 Claims, 12 Drawing Sheets

(56) References Cited

OTHER PUBLICATIONS

"International Application Serial No. PCT/IB2017/057428, Written Opinion dated Jul. 18, 2018", 8 pgs.
"International Application Serial No. PCT/IB2017/057428, International Preliminary Report on Patentability dated Jun. 11, 2020", 9 pgs.
"European Application Serial No. 17821730.3, Response to Communication pursuant to Rules 161(1) and 162 EPC filed Feb. 5, 2021", 19 pgs.
"Saudi Arabian Application No. Office Action dated Mar. 22, 2022", 12 pgs.
"Saudi Arabian Application Serial No. 20412067, Second Substantive Examination Report dated Jun. 30, 2022", w/ English Translation, 10 pgs.
"European Application Serial No. 17821730.3, Communication Pursuant to Article 94(3) EPC dated Aug. 2, 2022", 8 pgs.

* cited by examiner

ROTATIONAL HOUSING FOR AN RFID TAG ON A FUEL NOZZLE

CROSS-REFERENCE TO RELATED APPLICATIONS

The present application is a national stage application under 35 U.S.C. § 371 of PCT Application No. PCT/IB2017/057428, filed Nov. 28, 2017, which is hereby incorporated herein by reference in its entirety.

TECHNICAL FIELD

The present disclosure relates to a device and method for facilitating secure fuel delivery to a vehicle and, more specifically, to such a device and method that optimizes wireless communication between a vehicle and a fuel authorization system to reduce communication failures between a reader/interrogator associated with the fuel authorization system and a wireless communication tag associated with each vehicle, while ensuring the integrity of the fuel delivery process, simultaneously reducing instances of fuel theft and accommodating vehicles of varying physical geometries.

BACKGROUND

Automatic fuel authorization systems are commonly used for vehicles forming part of a fleet. The fuel authorization system forms part of a fleet management system and is commonly used as a tool to secure the fueling process. Fuel authorization systems are in place to try to reduce to a minimum fuel theft at the fuel delivery pump by ensuring that only authorized vehicles may be fueled at the fuel delivery pump. It should be appreciated that the devices and methods described herein have equal applicability to traditional non fleet fueling businesses, gas stations and the like utilized daily by consumers, as will be readily appreciated by those of ordinary skill in the art upon review of the present disclosure.

A fuel authorization system generally includes a remote fuel authorization server that authorizes fuel delivery at a fuel delivery pump for vehicles identified as an authorized fleet member. Wireless communication between the fuel authorization server and a communication device associated with the vehicle allows the server to identify and authenticate the vehicle. One example of a wireless communication device is a radio frequency identification (RFID) tag. The tag may comprise a memory that includes, but is not limited to, vehicle identification, type of fuel required and fuel payment data. The tag associated with each vehicle is typically located proximate the vehicle fuel tank filler neck inlet area. In order to gain authorization and activate fuel dispensing operations, the vehicle identification data must be corroborated and/or authenticated by the authorization server. The vehicle data is communicated to the authorization system wirelessly. Examples of communication protocols include but are not limited to RF-based communications, for example, ISO 14443 A, ISO 14443B, ISO 15693, ISO/IEC 18000, Near Field Communications (NFC), Bluetooth, Zigbee, and WiFi. Accordingly, the reader/interrogator, disposed on or otherwise associated with a fuel dispensing nozzle, wirelessly reads the vehicle identification (and other available data) and communicates that information to the authorization server. Critically, in order to obtain fuel authorization, the reader/interrogator must be able to accurately and properly read the vehicle tag, utilizing wireless communication, and communicate that information to the authorization server.

However, there is a practical limit to capability of the reader/interrogator. If a reader is too powerful, and the read distance too large, the authorization server may authorize fuel delivery with the pump nozzle removed from the vehicle fuel tank delivery neck. A read range that is too large permits theft by allowing separate and discrete fuel containers, and even other vehicles located nearby, to receive fuel. Ideally, the read range between the reader and the tag should be small enough to require the fuel delivery nozzle to be inserted in the vehicle fuel tank delivery neck before the reader can recognize and identify the vehicle tag. In addition, once identification and authorization is completed, if the fuel delivery nozzle is removed from the vehicle fuel tank delivery neck, communication should end and fuel delivery should terminate. But a read range that is too small can give rise to other wireless communication problems between the reader and tag. For example, physical orientation of the reader antenna relative to the tag antenna influences communication, as does the physical configuration of the vehicle proximate the fuel tank delivery neck and the large amount of metal comprising the vehicle itself.

U.S. published patent application 2016/0012261 (the '261 application), entitled RFID "Reader and Method for Securing Fuel Delivery With a Fuel Dispensing Nozzle," assigned to Orpak Systems, LTD., Israel, is one example of a wireless communication system for identification and authorization for dispensing fuel. Notably, the '261 application identifies a number of problems that lead to read errors with fuel dispensing authorization systems using RFID. These include variance in the placement and location of the RFID tag and communication antennae on the vehicle side, the geometry of the fuel tank delivery inlet area and materials forming the fuel tank inlet area, the distance from the vehicle tag to the RFID nozzle reader antennae, the type of nozzle utilized, the fuel dispensing nozzles geometry not congruent with the geometry of the fuel tank delivery inlet area, the shape of the fuel tank delivery neck, the like and/or any combination thereof that may lead to communication errors and/or read failures between the vehicle tag and the nozzle reader. (See '261 application at [0009].) The solution proposed by the '261 application is to locate the RFID reader around the fuel dispensing nozzle and to adjust the communication channel and/or frequency of the reader to more closely respond to the capability of the vehicle tag. (See '261 application at [0011-12].)

SUMMARY

Existing fuel authorization systems do not recognize nor address the problems arising from antenna orientation, the variation in the physical geometries of vehicles and the expanse of metal comprising the vehicle that can and do interfere with wireless communication. The present disclosure improves upon existing systems and enhances the ability of a wireless reader/interrogator associated with a fuel delivery nozzle to successfully communicate with the tag associated with a vehicle by making the reader and its antenna repositionable relative to the vehicle. Further, the reader is repositionable while the fuel delivery nozzle is positioned in and out the fuel inlet of a vehicle. By permitting reorientation of the reader/interrogator, the position of the reader/interrogator relative to the tag may be altered to improve communication. Permitting repositioning with the fuel delivery nozzle positioned in the fuel inlet of the vehicle, a position permitting improved or enhanced communication between the reader and a tag associated with the vehicle can be determined while accommodating a limited read range between the reader and tag. Repositioning includes rotation of the reader/interrogator about the fuel delivery nozzle and axial movement of the reader/interrogator along the fuel delivery nozzle.

According to aspects of the present disclosure, a connector is provided for attaching a radio frequency identification (RFID) reader to a fuel dispensing nozzle. The connector comprises a bracket affixed to and surrounding a fuel dispensing nozzle, at least a portion of the bracket is configured to rotate relative to the nozzle while another portion of the bracket remains fixed relative to the nozzle; and a housing is affixed to the bracket and configured to receive an RFID reader. The housing is repositionable by rotating the bracket and housing relative to the fuel dispensing nozzle. The repositioning of the housing can be done with the fuel delivery nozzle positioned in the fuel inlet of the vehicle or outside of the fuel inlet of the vehicle.

According to aspects of the present disclosure, a connector is provided for attaching a radio frequency identification (RFID) reader to a fuel dispensing nozzle. The connector comprises a collar assembly configured to surround and engage a fuel dispensing nozzle; a rotating bracket assembly engaged with the collar assembly and configured to rotate relative to the collar assembly; and a housing affixed to the rotatable bracket and configured to receive an RFID reader. The housing is repositionable by rotating the rotating bracket assembly and housing relative to the collar assembly and fuel dispensing nozzle. The repositioning of the housing and the rotating bracket assembly can be done with the fuel delivery nozzle positioned in the fuel inlet of the vehicle or outside of the fuel inlet of the vehicle.

According to aspects of the present disclosure, an embodiment of a connector is provided where a fixed collar assembly is mounted to a fuel dispensing nozzle, a rotating bracket assembly interfaces with and rotates relative to the fixed collar assembly and an RFID housing is connected to the rotating bracket such that the RFID housing and rotating bracket rotate relative to the fixed collar assembly to reposition the RFID bracket and the housing relative to the vehicle in which the fuel dispensing nozzle is positioned. One or more stabilizing members are provided to stabilize or hold the position of the rotating bracket assembly at discrete orientations or positions relative to the collar assembly, but also allow the rotating bracket assembly to move between the discrete positions. A radio frequency reader or reader module is contained within the housing and designed to communicate wirelessly with a radio frequency tag associated with a vehicle. Ideally, the tag is positioned proximate the fuel receiving inlet, but may not be positioned consistently among different vehicles. Improved communication between the reader and the tag may be available if the reader is repositionable relative to the tag. For this reason, the reader housing, containing the reader or reader module, is repositionable relative to the fuel dispensing nozzle and the vehicle.

According to aspects of the present disclosure, an embodiment is provided wherein a stabilizer or stabilizing member comprises a biased ball bearing and detent system. In one instance, a fixed collar assembly is secured to a fuel dispensing nozzle. The collar assembly comprises one or more collar members affixed to the nozzle and one or more bushings affixed radially outward of the collar members. A series of detents are positioned around the outer surface of the one or more bushings. A rotating bracket assembly surrounds the collar assembly. One or more bearings are positioned in the rotating bracket assembly and the one or more bearings are biased inwardly toward the collar assembly to interface with the detents. When one or more bearings are positioned in a detent, the rotating bracket assembly is stabilized and the RFID housing stays in a set position. The strength of the bias is adequate to hold the housing in position, but not so strong as to inhibit movement or repositioning of the RFID housing from one position to another position. The bias may be provided by a coiled spring or other structures known to those of skill in the art to bias the bearing inwardly toward the detents. It should also be appreciated that the biasing member and one or more bearings may alternatively be disposed in the collar assembly and the detents positioned along a surface of the rotating bracket assembly that is proximate the collar assembly. The stabilizing members can be arranged such that the housing can move between fixed angular positions, for example every 15 or 30 degrees, and can move in either direction, clockwise or counterclockwise. The number of biased bearings and detents and their position can vary.

According to another embodiment, the stabilizers or stabilizing members comprise first and second sets of attracting magnets. The magnets stabilize the position of the rotating bracket assembly and RFID housing relative to the fixed collar assembly at discrete locations while also permitting movement of the rotating bracket assembly between the discrete locations. As one example, a first set of magnets are positioned in the collar assembly with each individual magnet spaced from adjacent magnets. The second set of magnets is positioned in the rotatable bracket assembly and magnets are spaced apart. The rotatable bracket is stabilized in a fixed position when at least some of the first and second magnets are radially aligned. As an alternative, one of the first and second set of magnets may be a single magnet. The attractive force between the magnets is sufficiently strong to hold or stabilize the position of the rotatable bracket assembly. The attractive strength between the magnets, however, is not too strong that it cannot be overcome by manually moving the rotatable housing to the next position. The magnets can be arranged such that the housing can move between fixed angular positions, such as every 15 or 30 degrees, and can move in either direction, clockwise or counterclockwise. The number of magnets and the position where the magnets are aligned can vary.

According to aspects of the present disclosure and in connection with yet another embodiment, the stabilizers or stabilizing members may act axially relative to the fuel nozzle rather than radially. For example, detents could be formed in the side walls of the collar assembly and the one or more biased bearings are positioned in the rotatable bracket assembly to engage the detents. In operation, the one or more bearings would be biased axially to move in and out of the detents. Conversely, the one or more biased bearings could be positioned in the collar assembly and the detents located in the rotatable bracket assembly, but the movement of the one or more bearings remains in the axial direction. Similarly, in the context of the stabilizing members being magnets, the magnets may be disposed within the collar assembly and the rotatable bracket assembly to align axially rather than radially relative to the fuel nozzle.

According to aspects of the present disclosure, the RFID housing may also be configured to move linearly, along the fuel dispensing nozzle. Repositioning of the RFID housing thus may be rotational, linear or both. For example, the collar assembly may comprise a releasable clamping mechanism allowing the connection between the collar assembly and the fuel dispensing nozzle to be loosened, repositioned axially along the nozzle, and reengaged. Alternatively, a guide may be positioned along a length of the nozzle and the collar assembly configured to move linearly along the guide. Other mechanisms occurring to those of ordinary skill in the art upon review of this disclosure are deemed to be within the scope of the present disclosure.

According to aspects of the present disclosure, a method for enhancing the wireless communication between a radio frequency identification (RFID) tag associated with a vehicle and an RFID reader associated with a fuel delivery system is also provided. In one embodiment, the method comprises providing a bracket configured to attach to a nozzle of a fuel delivery system; attaching the bracket to the nozzle of a fuel delivery system; attaching to the bracket a housing configured to hold an RFID reader; and repositioning the housing and at least a portion of the bracket relative to the nozzle. The method also includes repositioning of the housing with the nozzle positioned in the fuel inlet of a vehicle.

According to aspects of the present disclosure, embodiments permit changing the frequency of the RFID reader antenna to match the frequency of the RFID tag associated with the vehicle. The resonant frequency of the reader antenna and tag antenna can vary with changes in temperature. Because the RFID reader and tag are located outside each is subject to a wide variety of changes in environment. However, the reader resonant frequency does not change nearly as much as the resonant frequency of the tag. Therefore, being able to vary the frequency of the reader antenna to match that of the tag antenna improves communication. The reader antenna can be altered by a microcontroller sensing the temperature via on-board temperature sensors and then adjusting the operational frequency of the reader via firmware configuration of the microcontroller which controls the RFID reader to correspond to the assumed frequency of operation of the tag. Following the change in operational frequency, the reader will then re-tune its RFID driver circuit to be resonant at the new operational frequency. As one example, the effective capacitance of a parallel bank of capacitors within an RLC driver circuit is changed. According to aspects of the present disclosure, a plurality of temperature zones will be defined. In one embodiment there may be three temperature zones. In the middle temperature zone (which may extend for example from −10° C. to +40° C., the reader will operate at a predetermined frequency (e.g., 125 kHz). Above+40° C. the system will change the operational frequency to a second predetermined frequency (e.g., 121 kHz), and below −10° C. the system will change the operational frequency to a third predetermined frequency (e.g., 129 kHz). It should be appreciated that the number of zones and the predetermined frequencies may vary.

Further still, it should be expected that no two vehicles will necessarily use the same tag nor operate precisely at the same frequency. Therefore, according to aspects of the present disclosure, the system microprocessor may be configured to permit the microprocessor to optimize communication with the tag by scanning through a plurality of RFID frequencies and identifying the frequency which best suites communication with a specific vehicle tag.

According to aspects of the present disclosure, communication performance may also be improved by adding shielding to the RFID housing to address potential sources of interference with communication between the RFID reader and tag. This may be accomplished in a number of ways as would be known by a person of ordinary skill in the art. As one example, biaxially-oriented polyethylene terephthalate (BoPET or Mylar) may form an effective shield.

The Summary is neither intended nor should it be construed as being representative of the full extent and scope of the present invention. Moreover, reference made herein to "the present disclosure" or aspects thereof should be understood to mean certain embodiments of the present disclosure and should not necessarily be construed as limiting all embodiments to a particular description. The present disclosure is set forth in various levels of detail in the Summary as well as in the attached drawings and the Detailed Description and no limitation as to the scope of the present disclosure is intended by either the inclusion or non-inclusion of elements, components, etc. in this Summary.

BRIEF DESCRIPTION OF THE DRAWINGS

The accompanying drawings, which are incorporated in and constitute a part of the specification, illustrate embodiments of the present disclosure and together with the general description given above and the detailed description of the drawings given below, serve to explain the principles of the present disclosure.

It should be understood that the drawings are not necessarily to scale. In certain instances, details that are not necessary for an understanding of the present disclosure or that render other details difficult to perceive may have been omitted. It should be understood, of course, that the present disclosure is not necessarily limited to the particular embodiments illustrated herein.

DETAILED DESCRIPTION

Figure 1:
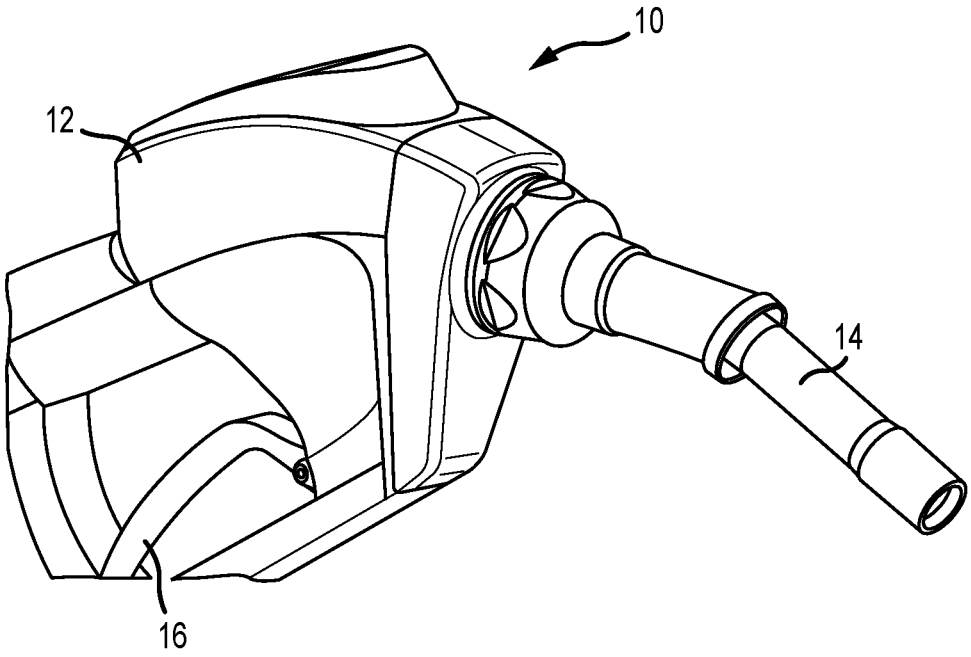
FIG. 1 is a perspective view of a conventional fuel delivery nozzle.
Figure 2:
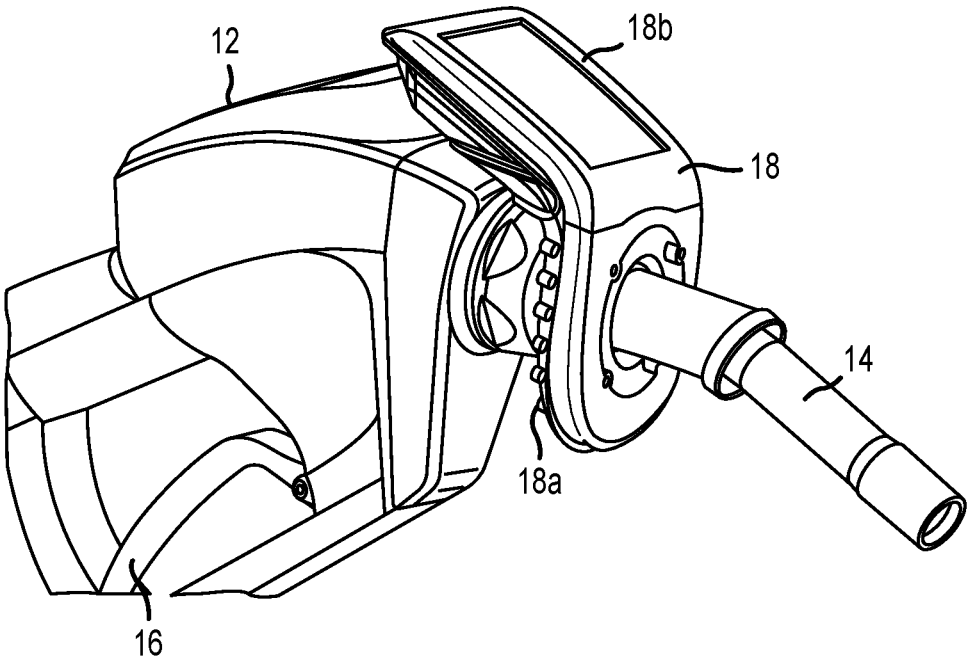
FIG. 2 is a perspective view of the fuel delivery nozzle of FIG. 1, further including a repositionable radio frequency identification housing mounted on the nozzle.

FIGS. 1 and 2 illustrate a conventional fuel delivery nozzle 10. The fuel delivery nozzle 10 includes a handle portion 12, a nozzle 14 for insertion into a vehicle fuel receiving port (not shown) and a lever 16 to open a valve internal to the handle portion 12 to actuate fuel flow. FIG. 2 illustrates a rotatable radio frequency (RFID) housing 18 mounted on the conventional fuel delivery nozzle 10 of FIG. 1.

Turning to FIGS. 3 and 4A-C, one embodiment of the components that permit rotation of the RFID housing 18 about the nozzle 14 is shown. More specifically, a fixed collar assembly 20 comprising opposing arcuate collars 22*a* and 22*b* and opposing arcuate shaped bushings 24*a* and 24*b*, a rotating bracket assembly 26 comprising rotational wings 28*a* and 28*b*, front plate 30 and rear plate 32, and stabilizing members 34 are shown. The collars 22*a* and 22*b* include flanges 40*a* and 40*b* for purposes of interconnecting one collar to another. An aperture 42 is formed in each flange. When installed, the inner surface 44 of each collar 22 abuts the outer surface of the fuel nozzle 14 and may be held in place by friction. Alternatively, an adhesive, such as Loctite (made by Loctite Corporation, Westlake, Ohio, USA) may be applied between the outer surface of the nozzle 14 and the inner surface 44 of the collars 22*a* and 22*b* to enhance the fixed position of the collars 22*a* and 22*b* relative to the nozzle 14. The flanges 40*a* and 40*b* are overlapped when installed and the apertures 42 aligned to receive a dowel, set screw 46 (FIG. 8) or other connector (not shown) that is inserted into the apertures 42. The collar is illustrated as two semi-circular pieces. It should be appreciated that the collar could be a single "C-shaped" member that is closed or crimped about the nozzle, or three or more arcuate shaped members.

Figure 4A:
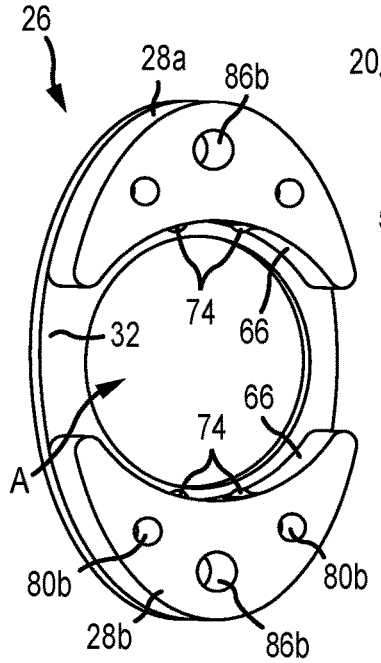
FIG. 4A is a perspective view of one embodiment of a rotating bracket assembly, with a front plate removed.
Figure 4B:
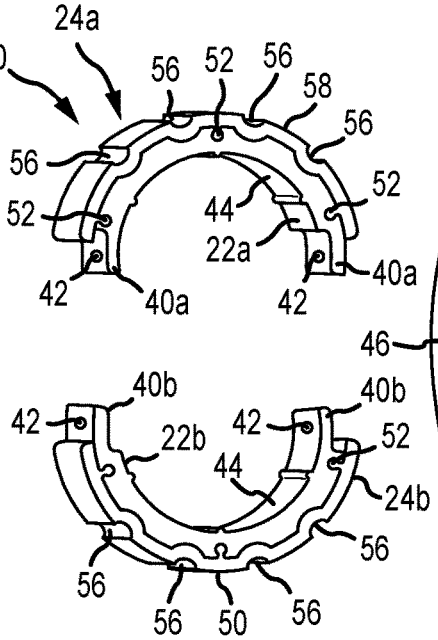
FIG. 4B is perspective view of one embodiment of a partially assembled collar assembly.

Slots 48 are formed in the outer surface 50 of the collars 22*a* and 22*b* to receive connecting posts 52 formed on the inner surface 54 of the bushings 24*a* and 24*b*. According to one embodiment, a plurality of detents 56 is spaced along the outer surface 58 of the bushings 24*a* and 24*b*. Depending upon the radial thickness of the bushings 24*a* and 24*b*, a plurality of projections 60, corresponding to the detents 56, may be formed on the inner surface 54 of the bushing 24*a* and 24*b*. To accommodate the radially inward curvature of the projections 60, indentations 62 corresponding to the projections 60 may be formed in the outer surface 50 of the collars 22*a* and 22*b*. The interconnection of the posts 52 in the slots 48, together with the nesting of the inner surface 54 of the bushings 24*a* and 24*b* and the outer surface 50 of the collar members 22*a* and 22*b*, assists in maintaining the bushings 24*a* and 24*b* in a fixed position relative to the collars 22*a* and 22*b*. Alternatively, the inner surface of the bushings 24*a* and 24*b* and the outer surface 50 of the collar members 22*a* and 22*b* may be configured differently, for example in a saw-toothed pattern, as smooth surfaces or in other ways as would be appreciated by those of skill in the art upon review of the present disclosure, to enhance maintaining the bushings 24 and collar members 22 in a fixed position relative to each other. Also, according to aspects of the present disclosure, the bushings 24*a* and 24*b* alternatively may comprise a single C-shaped member or three or more arcuate shaped members that connect to the collar members. FIG. 4B illustrates the collar assembly 20 partially assembled.

Figure 3:
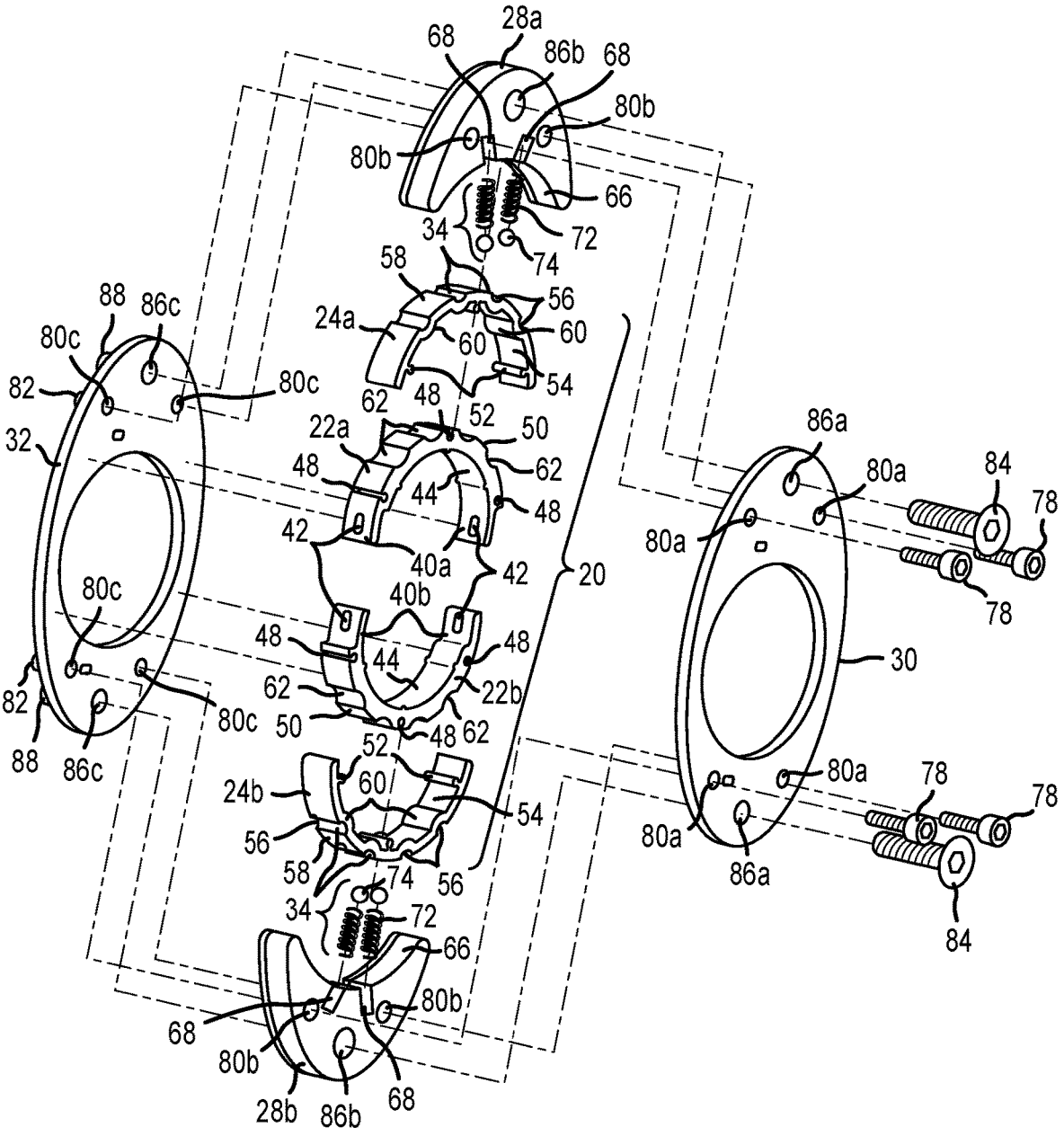
FIG. 3 is an exploded view of a first embodiment of a rotational assembly.
Figure 4C:
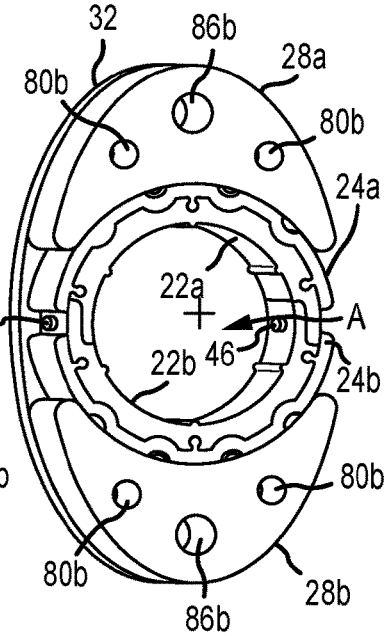
FIG. 4C is a perspective view of the collar assembly of FIG. 4B assembled with the rotating bracket assembly of FIG. 4A.

The rotational wings 28*a* and 28*b* are configured to interface with the bushings 24*a* and 24*b*. In one embodiment, the wings are generally crescent-shaped with a generally arcuate-shaped inner surface 66. When assembled with the front plate 30 and back plate 32, the inner surface 66 of the rotational wings aligns with the outer surface 50 of the bushings 24*a* and 24*b*. Cavities 68 are formed in the wings 64. The cavities 68 receive stabilizers or stabilizing members 34. The stabilizing members 34 as illustrated comprise a spring 72, a ball bearing 74 and a plurality of detents 56. The spring 72 biases the bearing 74 radially inwardly toward the outer surface 50 of the collar 22*a* and 22*b*. As illustrated, there are four detents 56 spaced along the outer surface 50 of each of the bushings 24*a* and 24*b*, and there are two bearing assemblies positioned in each rotational wing 28. Together with the front plate 30 and rear plate 32, the wings 74 and stabilizing members 34 comprise a rotating bracket assembly 26. Screws 78 extend through apertures 80*a*, 80*b* and 80*c* in the front plate 30, wings 28 and back plate 32, respectively to secure the component pieces together. Internally threaded posts 82 in the rear plate 32 receive the screws 78. As explained below, screws 84 extend through apertures 86*a*, 86*b* and 86*c*, and engage internally threaded post 88 to secure the RFID housing 18 to the rotating assembly 26. FIG. 4A illustrates a partially assembled rotating bracket assembly 26. When a bearing 74 is aligned with a detent 56, the bearing 74 nests in detent 56 and stabilizes the position of the rotating bracket assembly 26 relative to the collar assembly 20. The springs 72 permit the bearings 74 to retract into the cavities 68 when the rotating bracket assembly 76 is rotated. It should be appreciated that additional stabilizing members 34 than shown in FIG. 3 can be added or fewer stabilizers may be utilized. According to aspects of the present invention, a stabilizer may comprise a single biased bearing and a plurality of detents. It should be further appreciated that the position of the stabilizing members and detents may be switched. In other words, the springs 72 and ball bearings 74 may be positioned in the collar assembly 20 and the detents formed in the inner surface 66 of the wings 74. FIG. 4C illustrates an assembled collar assembly 20 and rotating bracket assembly 26, with the front plate 30 omitted for clarity.

While two wings 28*a* and 28*b* are illustrated, it should be appreciated that the rotating bracket assembly 26 may comprise a single wing 28 or three or more wings 28. Although the wings 28*a* and 28*b* are symmetrically positioned relative to the collar assembly 20, the wings may be asymmetrically positioned.

Figure 6A:
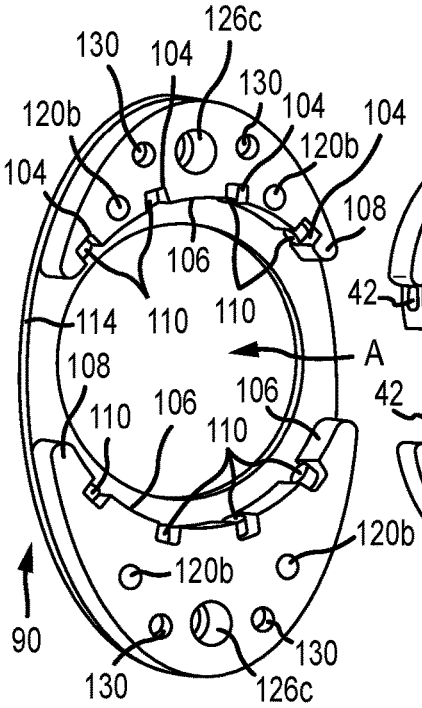
FIG. 6A is a perspective view of another embodiment of a rotating bracket assembly, with a front plate removed.
Figure 6B:
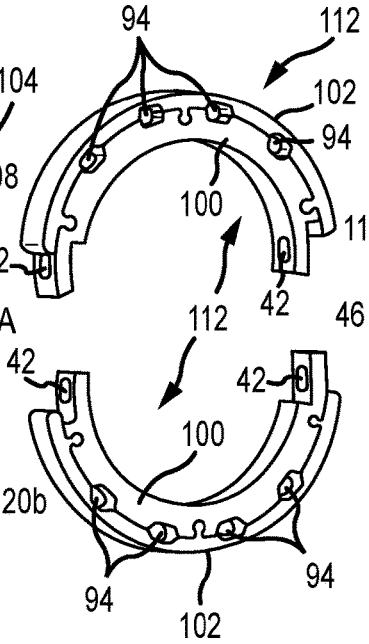
FIG. 6B is perspective view of another embodiment of a partially assembled collar assembly.
Figure 6C:
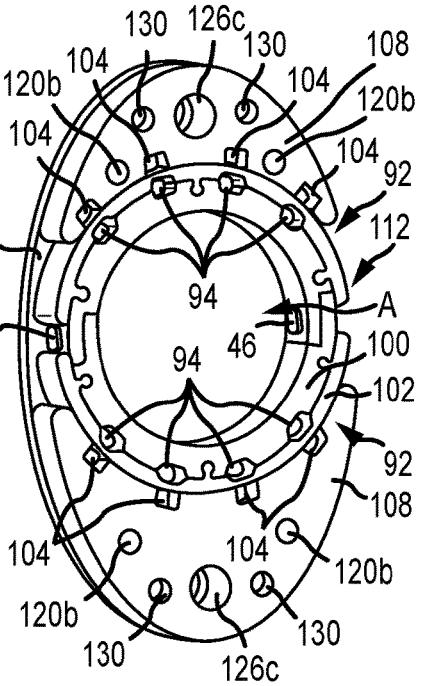
FIG. 6C is a perspective view of the collar assembly of FIG. 6B assembled with the rotating bracket assembly of FIG. 6A.

According to aspects of the present disclosure, a second embodiment 90 of a rotating bracket assembly is illustrated in FIGS. 5 and 6A-C. Here, the stabilizers or stabilizing members 92 are different from stabilizing members 34. Magnets replace the biased ball bearings and detents. More specifically, a series of spaced pockets 94 are formed by mating recesses 96 and 98 formed in the collar members 100*a* and 100*b* and the bushings 102*a* and 102*b*, respectively, when assembled. Pockets 104 are formed along the interior surface 106 of the wings 108. Magnets 110 are positioned in the pockets 94 and 104 in a manner that the magnets are attractive to each other. When a magnet 110 in pocket 94 is radially aligned with a magnet in pocket 104, the attractive force between the magnets 110 stabilizes the position of the rotating bracket assembly 90. However, the magnetic force is not so strong as to prevent the rotating bracket member 90 from rotating relative to the collar assembly 112 (comprising collar members 100 and bushings 102). Alternatively, only a single pocket 94 may hold a magnet while each of the pockets 104 holds a magnet, or a single pocket 104 may hold a magnet and each of the pockets 94 holds a magnet. Front plate 114 and rear plate 116 complete the rotating assembly 90. FIG. 6B illustrates a partially assembled collar assembly comprising collar members 100 and bushings 102. FIG. 6A illustrates a partially assembled rotating bracket assembly 90, with the front plate 114 omitted. FIG. 6C illustrates a rotating bracket assembly 90, with the front plate 114 removed, together with a collar assembly 112. It should be appreciated that the rotating bracket assembly 90 may comprise a single wing 108 or a plurality of wings 108 beyond the two wings illustrated. When a plurality of wings 108 are utilized, the wings may be symmetrically or asymmetrically positioned relative to the collar assembly 112.

Figure 5:
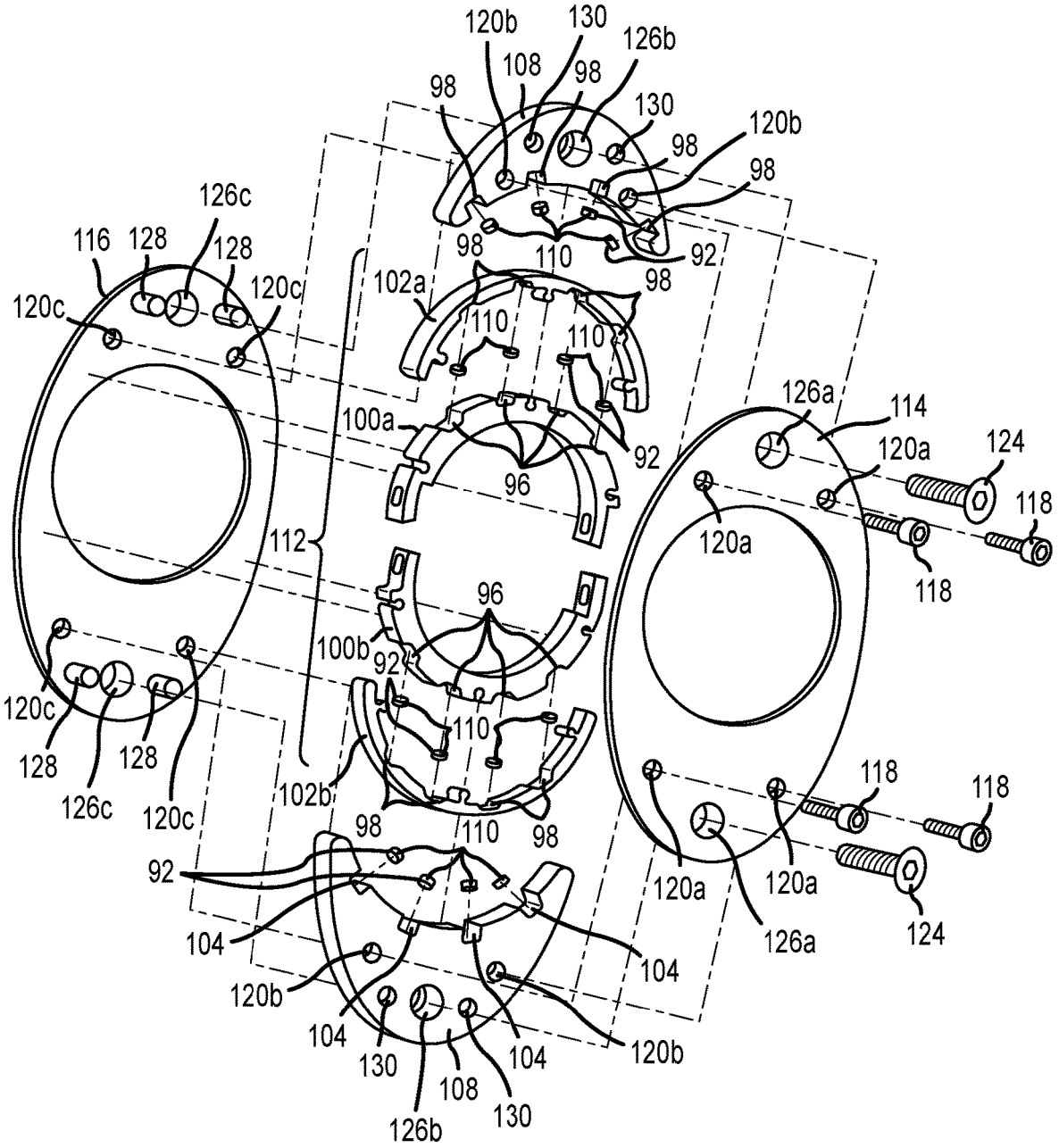
FIG. 5 is a perspective view of a second embodiment of a rotational assembly.

Screws 118 extend through apertures 120*a*, 120*b* and 120*c* in the front plate 114, wings 108 and back plate 116, respectively to secure the component pieces together. Internally threaded posts 122 in the rear plate 116 (not shown) receive the screws 118. Screws 124 extend through apertures 126*a*, 126*b* and 126*c*, and engage internally threaded post 128 to secure the RFID housing 18 to the rotating assembly 90. FIG. 6A illustrates a partially assembled rotating bracket assembly 90. FIG. 6B illustrates a partially assembled collar assembly 112. FIG. 4C illustrates an assembled collar assembly 112 and rotational bracket assembly 90, with the front plate 114 removed for clarity. As also shown in FIG. 5, alignment posts 128 projecting from the rear plate 116 fit in apertures 130 in the wings 108 to assist in assembly and stabilization of the rotating bracket assembly 112.

Figure 7:
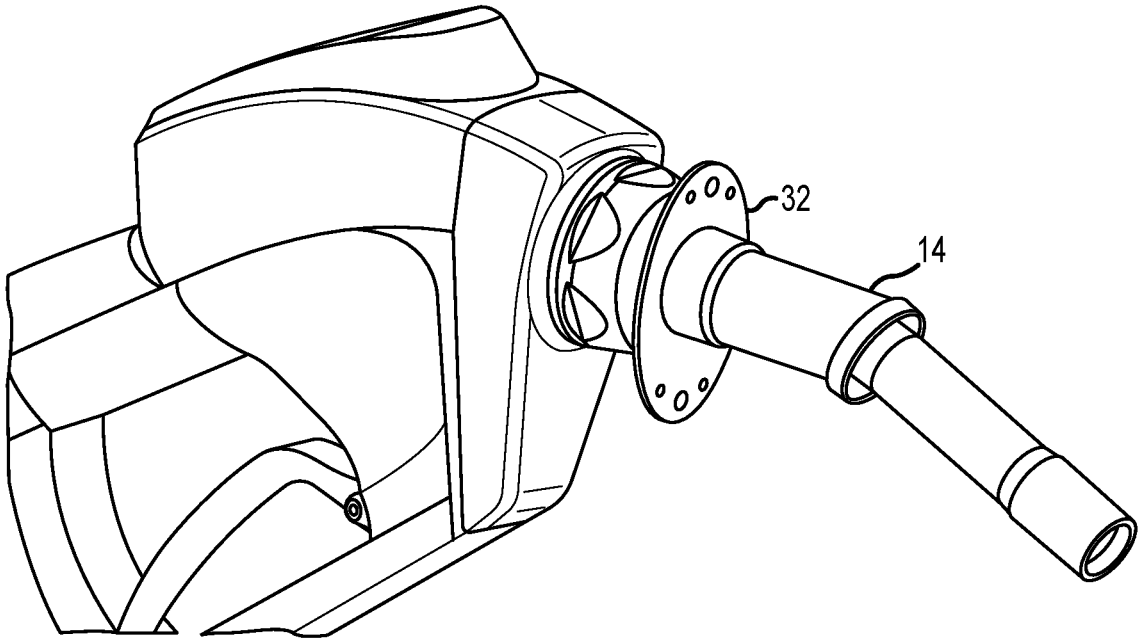
FIG. 7 is a perspective view of a fuel delivery nozzle with one embodiment of a back plate of a rotational assembly mounted thereon.
Figure 8:
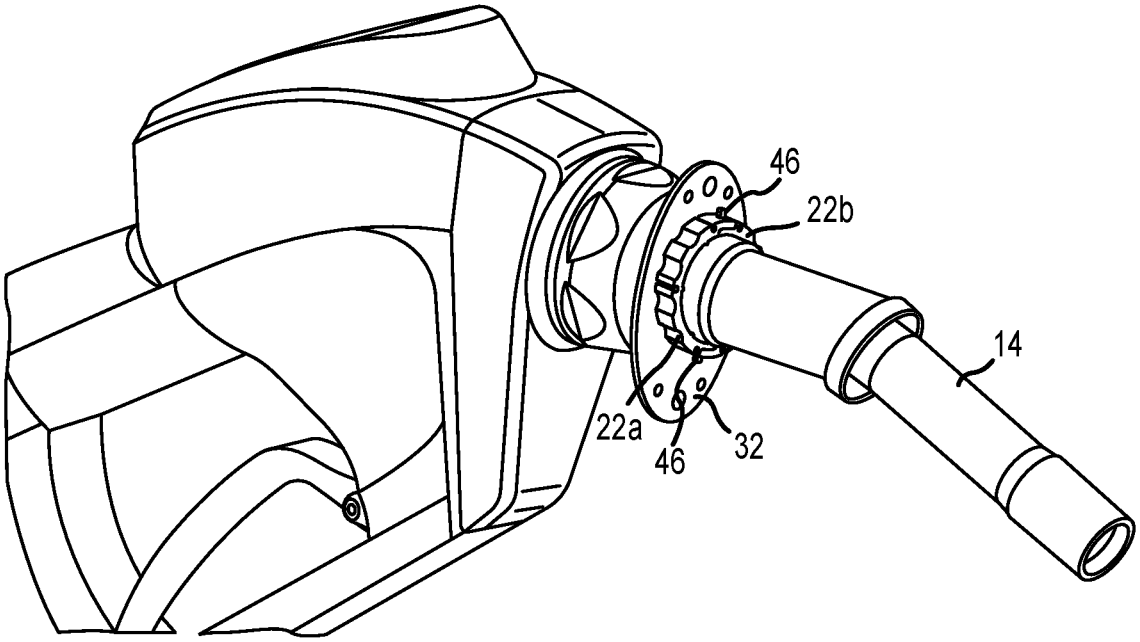
FIG. 8 is a perspective view of the embodiment illustrated in FIG. 7, further depicting two collar members mounted thereon.

Assembly and operation of a rotational RFID housing will now be described in connection with the embodiment of FIG. 3. Assembly of the embodiment of FIG. 5 is similar and will be readily understood by those of ordinary skill in the art without further explanation. According to aspects of the present disclosures, as a first step and with reference to FIG. 7, the rear plate 32 is positioned on the nozzle 14 with the nozzle 14 extending through the center aperture A in the rear plate. With reference to FIG. 8, a pair of mating collars 22*a* and 22*b* are then attached to the nozzle 14. As previously noted, the collars 22*a* and 22*b* may be crimped to the nozzle as part of the connecting process. An adhesive could also be applied between the nozzle and the inner surface 44 of the collars. As part of the connection process, the flanges 40 are overlapped and the apertures 42 aligned. A dowel 46 is then positioned in the apertures 42 to connect to the two collar members 22*a* and 22*b*. The dowel is sized to create a friction fit with the surface of the apertures. A set screw could be used in place of the dowel with the surface of the apertures threaded to receive the set screw. A single collar member with overlapping flanges or three or more arcuate collar members could be substituted. Once the one or more collar members are in place, the collar 22 does not move relative to the nozzle 14.

Figure 9:
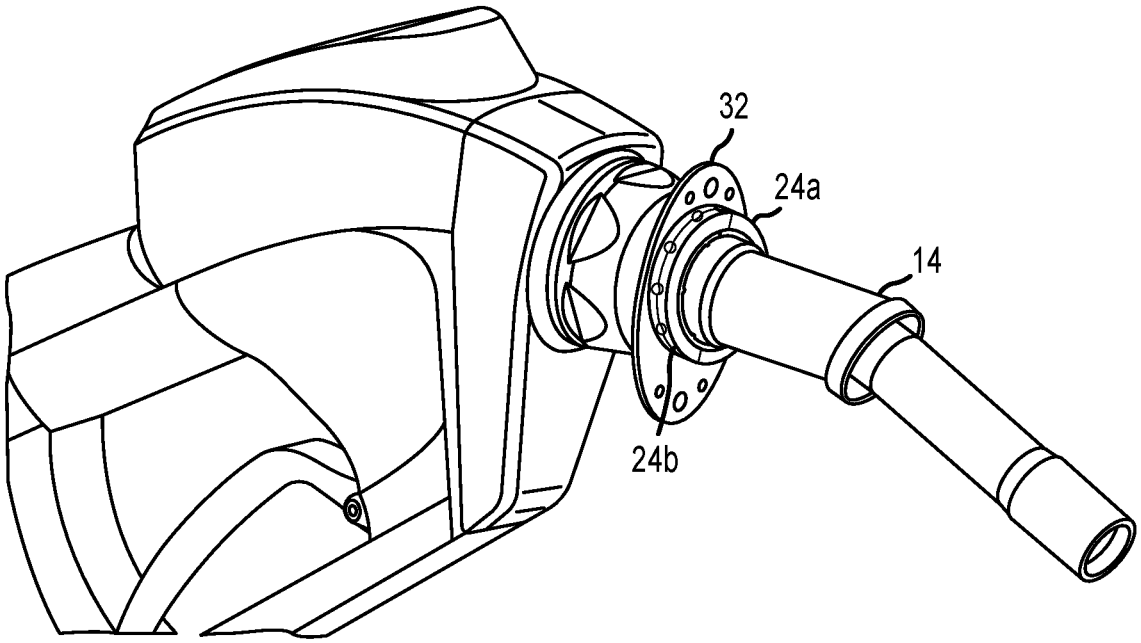
FIG. 9 is a perspective view of the embodiment illustrated in FIG. 8, further depicting four bushings mounted on the collar members

As illustrated in FIG. 9, the bushings 24*a* and 24*b* are then positioned on the outer surface 50 of the collars 22*a* and 22*b*. The bushings 24*a* and 24*b* are physically attached to the collar members 22*a* and 22*b*. Slots 48 formed in the outer surface 50 of the collar members receive radially inwardly extending posts 52 formed along the inner surface 54 of the bushings 24*a* and 24*b*. In addition, an adhesive, could supplement the connection of the bushings and collar members. The inner surface 54 of the bushing is configured to mate with the outer surface 50 of the collar members 22*a* and 22*b*. Different surface configurations may be used to assist or facilitate mating between the collar members 22*a* and 22*b* and the bushings 24*a* and 24*b*. When assembled, the bushings 24*a* and 24*b* are fixed relative to the nozzle 14. The assembled collar members 22*a* and 22*b* and the bushings 24*a* and 24*b* comprise a collar assembly 20.

Figure 10:
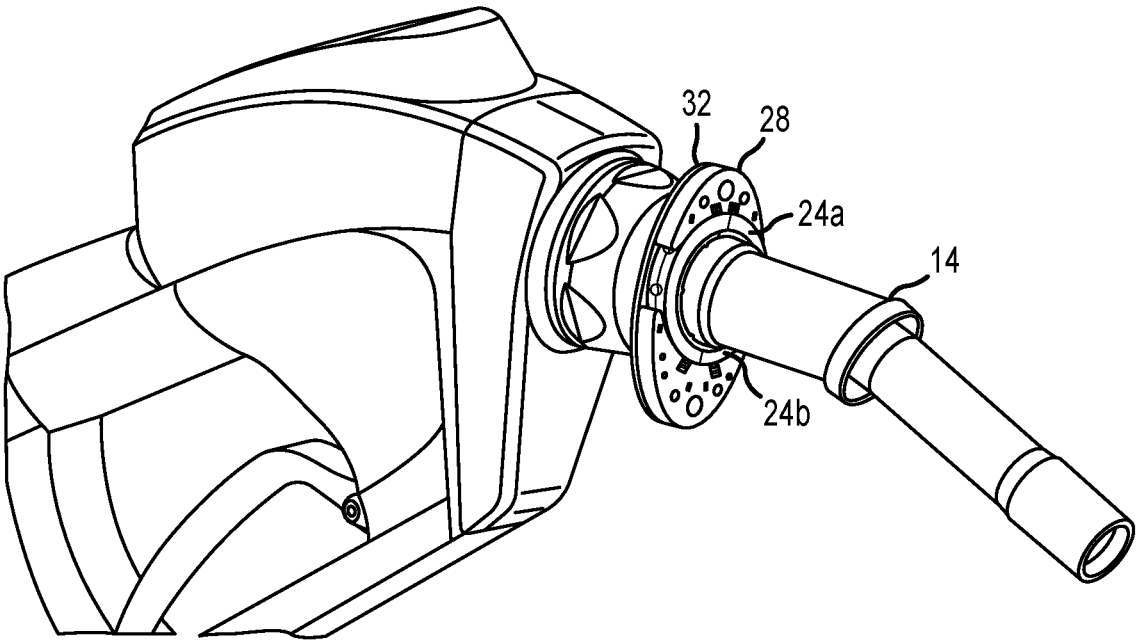
FIG. 10 is a perspective view of the embodiment illustrated in FIG. 9, further depicting a pair of rotatable wings mounted thereon.
Figure 11:
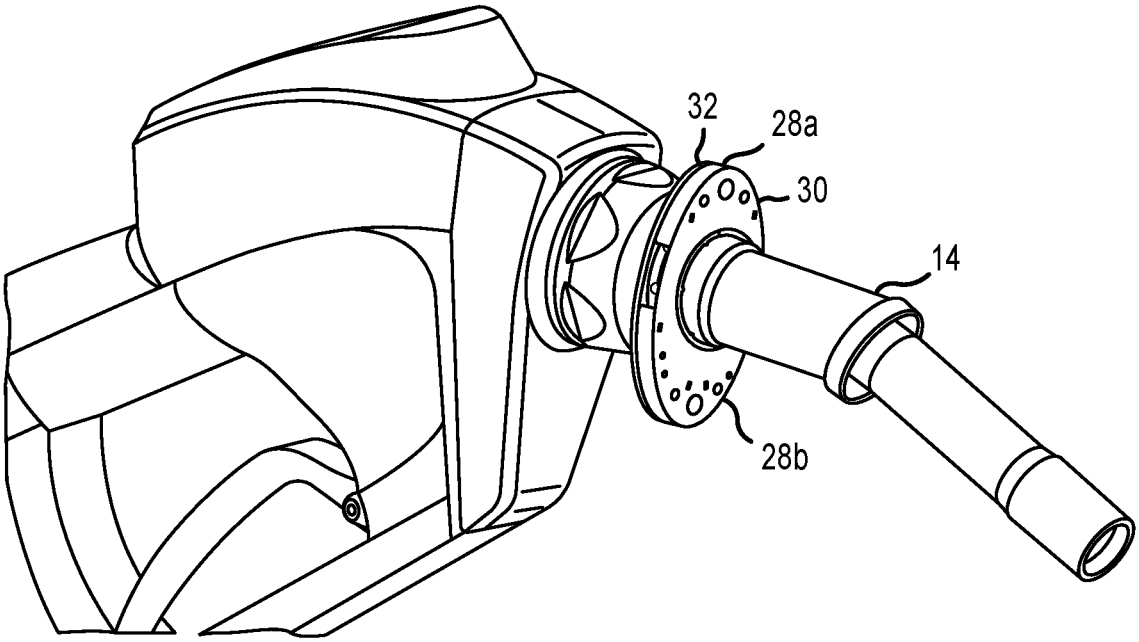
FIG. 11 is a perspective view of the embodiment illustrated in FIG. 10, depicting one embodiment of a rotational assembly mounted on the fuel delivery nozzle.

Turning to FIG. 10, the remainder of rotating bracket assembly 26 is then assembled and affixed to the collar assembly 20. As previously explained, the rotational assembly 20 includes the wings 28, backplate 32 and front plate 30. The backplate 32 was previously positioned on nozzle 14 prior to assembly of the collar members and bushings. The wings 28 and stabilizing members 34 are assembled next. As illustrated in FIG. 11, the front plate 30 is added to complete assembly of the rotating bracket assembly 26. The wings 64 are captured between the front plate 30 and back plate 32. Screws 78 are used to interconnect the front plate 30, backplate 32 and wings 28, with the inner surface 66 of the wings 28 positioned proximate the outer surface 50 of the bushings 24.

Figure 13:
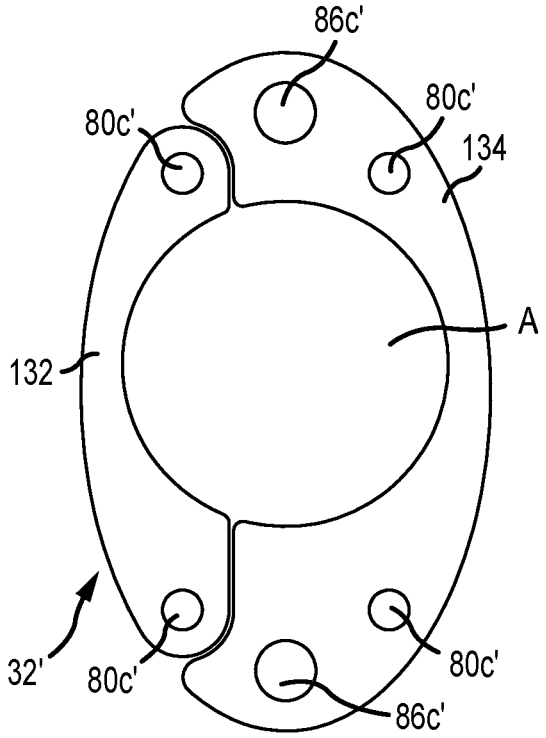
FIG. 13 is a top plan view of an alternative embodiment of a back plate of a rotational assembly.
Figure 14:
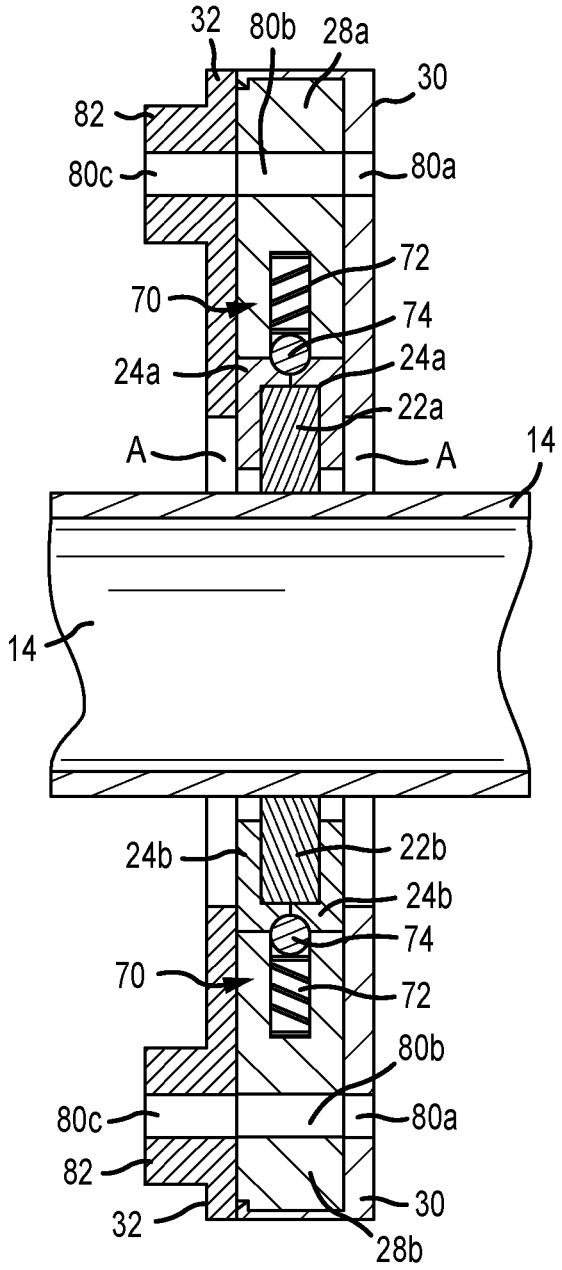
FIG. 14 is a cross section of the rotational assembly of FIG. 11, taken along a line that illustrates two stabilizing members.

An alternative rear plate 32' is illustrated in FIG. 13. Here, one side or edge 132 of the rear plate 32' is separate allowing the second or remaining portion 134 of the rear plate 32 to slip over the nozzle 14 after the collar assembly 20 is affixed to the nozzle 14. The first and second sides 132 and 134 are then separately connected to the wings 28*a* and 28*b* and front plate 30 with screws 78 thereby connecting the rotating bracket assembly 26 to the collar assembly 20. As shown in the cross-sectional view of FIG. 14, the center aperture A in the front plate 30 and backplate 32 has a smaller diameter compared to the diameter of the collar assembly 20, e.g., the assembly of the collar members 22*a* and 22*b* and the bushings 24*a* and 24*b*. As a result, the front plate 30 and rear plate 32 hold the position of the wings 28 relative to the bushings 24. In this manner, the rotational assembly 26 is able to rotate relative to the fixed bushings 24 and collar 22 but cannot separate from the collar assembly 20.

Figure 12:
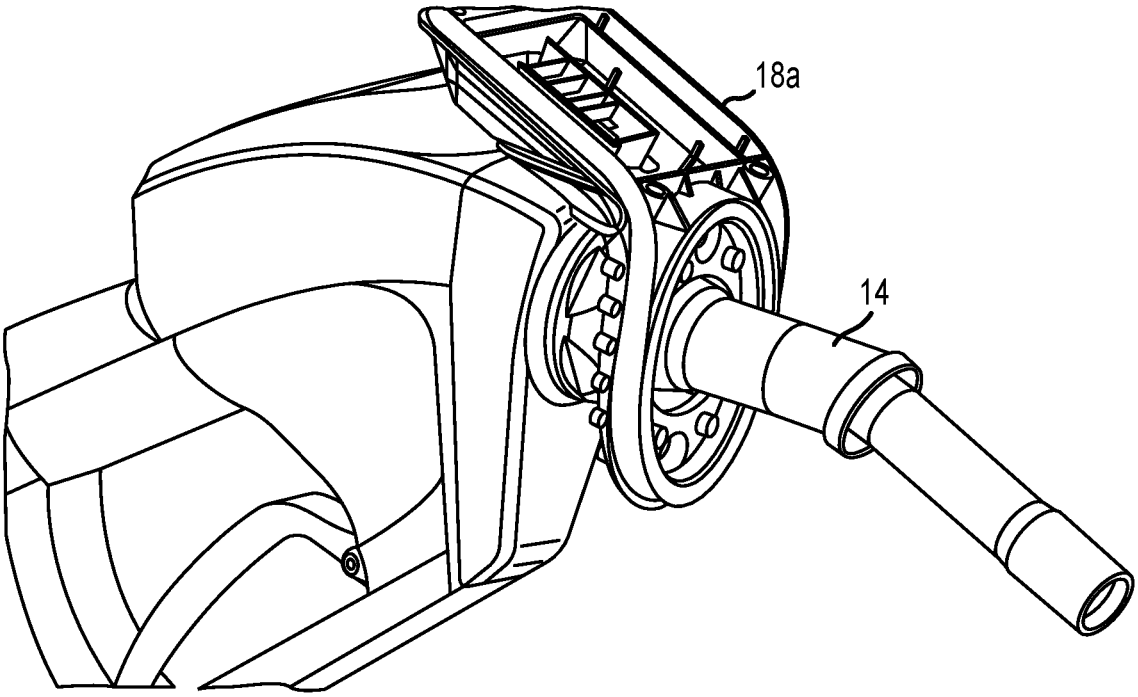
FIG. 12 is a perspective view of the embodiment illustrated in FIG. 11, further depicting the rear portion of an RFID housing connected to the rotational assembly.

Turning to FIG. 12, the RFID housing 18 is then connected to the rotational assembly 26. As a first step, the back half 18*a* of the housing 18 is connected by screws 84 to the apertures 86*a* in the front plate 30, apertures 86*b* in the wings 28*a* and 28*b*, apertures 86*c* and threated posts 88 in the rear plate 32. Typically, the reader electronics are preassembled in the housing, but could be added after the housing is assembled onto the nozzle. Once assembled, the front half 18*b* of the housing 18 is attached to complete the assembly (FIG. 2). As a result, the RFID housing 18 is rotatably fixed to the fuel nozzle 14. According to aspects of the present disclosure, the reader electronics comprises processing and communication circuitry, perhaps in the form of a microprocessor, a power supply and at least one antenna.

Figure 15A:
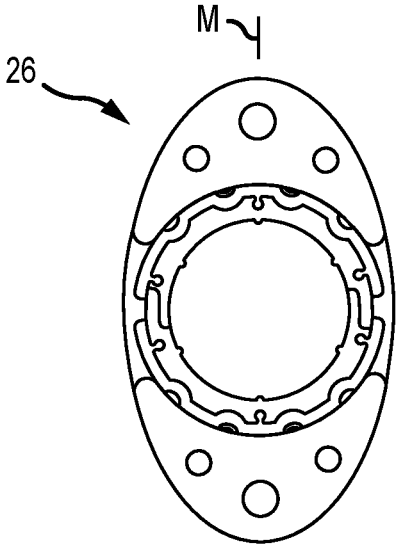
FIGS. 15A-F are top plan views of the rotational assembly of FIG. 3, with the front plate removed, depicted in six different orientations relative to the collar assembly.
Figure 15B:
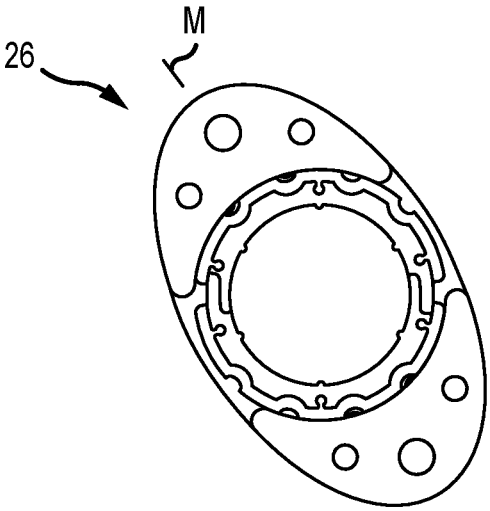
Figure 15C:
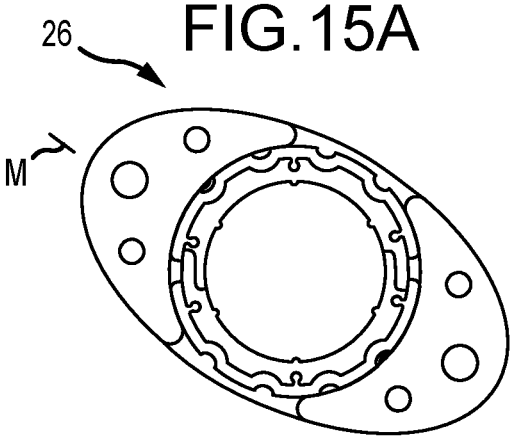
Figure 15D:
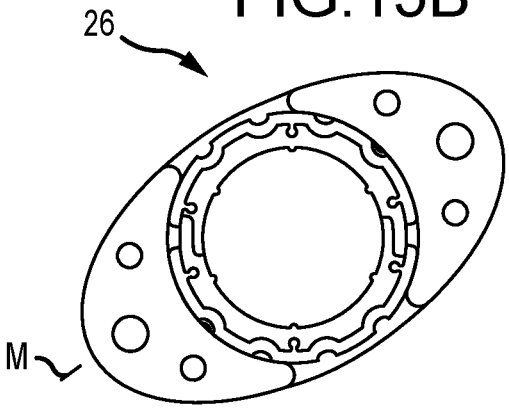
Figure 15E:
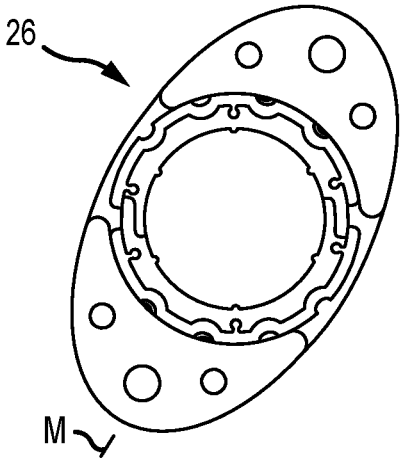
Figure 15F:
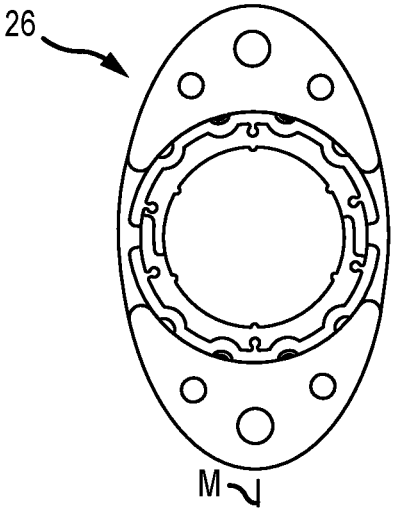

In operation, depending upon the configuration of the fuel nozzle 14, the RFID housing 18 is able to rotate 360 degrees about the nozzle 14. However, in many instances, access to the fuel inlet port of a vehicle requires opening of a hinged door. The hinged door may not permit a full 360-degree rotation of the RFID housing 18, but it will permit approximately 180 degrees of rotation, if not more. Similarly, some nozzles 14 are configured in a manner that prevents 360 degrees of rotation. FIGS. 15A-F show the rotating member 26 positioned at various locations about the collar assembly 20 through a 180-degree rotation. In some instances, all four stabilizing members 34 are engaged in a detent 56 (FIGS. 15 A, B, E and F) and in some instances only two stabilizing members 70 are engaged in a detent (FIGS. 15C and D). A notch mark M is added to highlight the rotation of the rotating bracket assembly 26. In FIG. 15A the rotating bracket assembly 26 is vertically oriented. In FIG. 15B, the rotating bracket assembly has rotated counterclockwise approximately 15 degrees. In FIG. 15C, the rotating bracket assembly has rotated about 45 degrees. In FIG. 15D, the rotating bracket assembly has rotated about 105 degrees. In FIG. 15E, the rotating bracket assembly has rotated about 165 degrees. In FIG. 15F, the rotating bracket assembly has rotated about 180 degrees. In each position illustrated in FIGS. 15A-F, the rotating bracket assembly 26 is sufficiently stable to hold its position, and the position of the RFID housing 18, without additional support.

FIGS. 16A-L shown the rotating assembly 90 positioned at various locations relative to the fixed collar members 100 and bushings 102 through a 360-degree rotation. In some instances, all eight pairs of magnets are radially aligned (FIGS. 16A and G) and in the other instances, less than all eight pairs of magnets are aligned (FIGS. 16B-F and H-L). In each instance the aligned stabilizing member 92 are sufficient to stabilize the RFID housing relative to the nozzle 14. More specifically, when pockets 94 and 104 are aligned, pairs of magnets 110 are aligned and the attracting forces are sufficient to stabilize the RFID housing. This is true even when less than all of the pairs of stabilizing magnets are aligned. Mark M shows the changing orientation of the rotating bracket assembly 90.

Figure 16A:
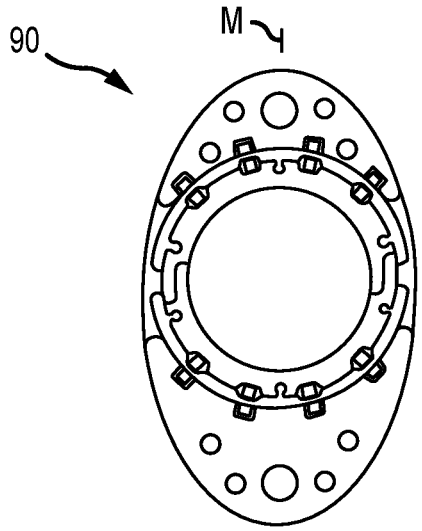
FIGS. 16A-L are top plan views of the rotational assembly of FIG. 5, with the front plate removed, depicted in twelve different orientations.
Figure 16B:
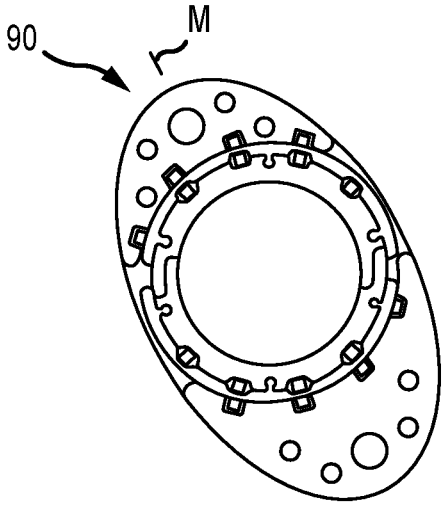
Figure 16C:
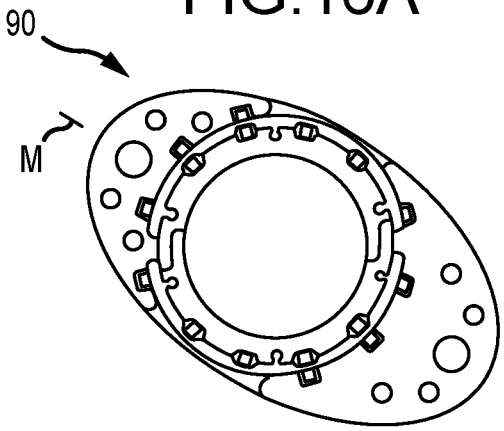
Figure 16D:
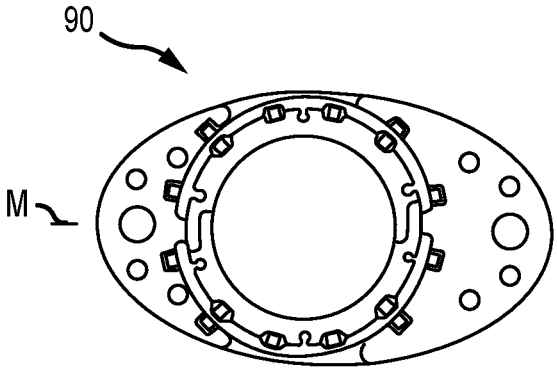
Figure 16E:
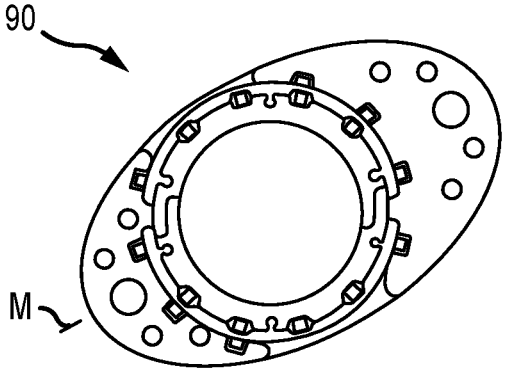
Figure 16F:
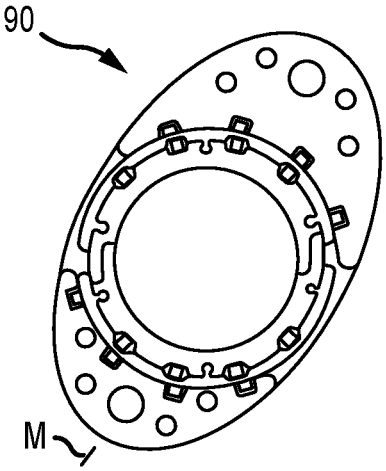
Figure 16G:
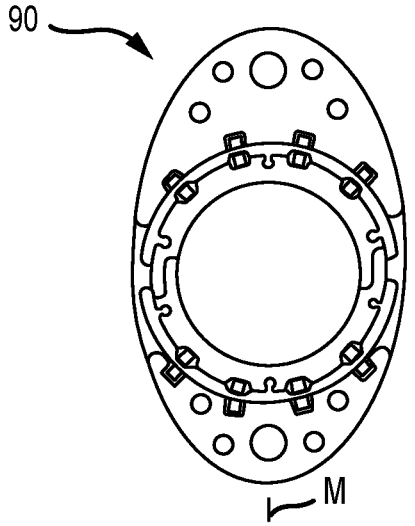
Figure 16H:
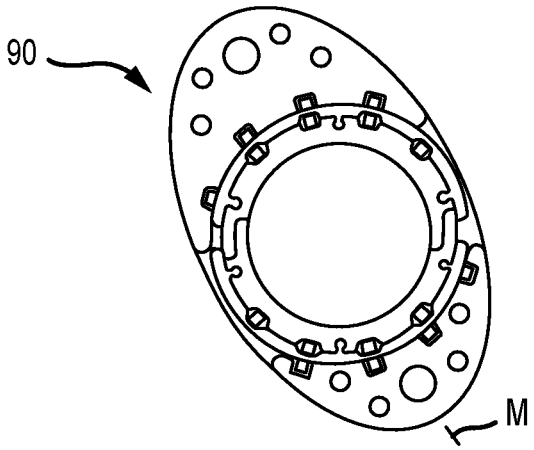
Figure 16I:
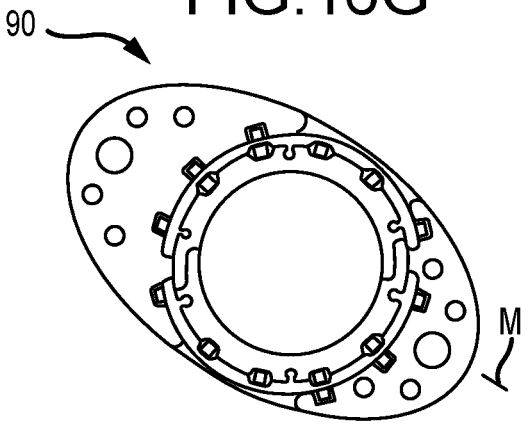
Figure 16J:
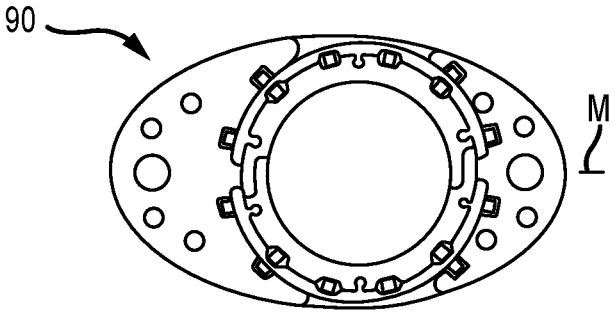
Figure 16K:
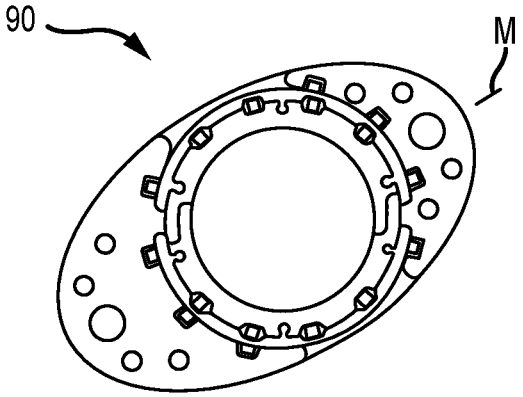
Figure 16L:
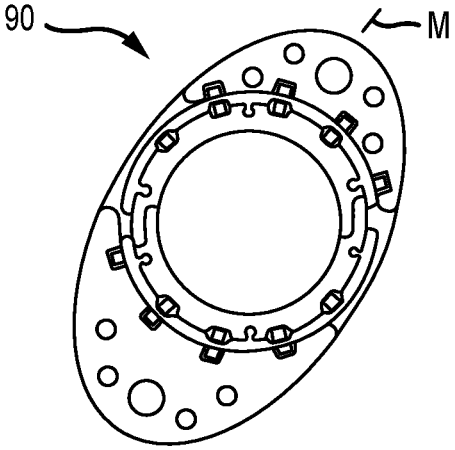
Figure 17A:
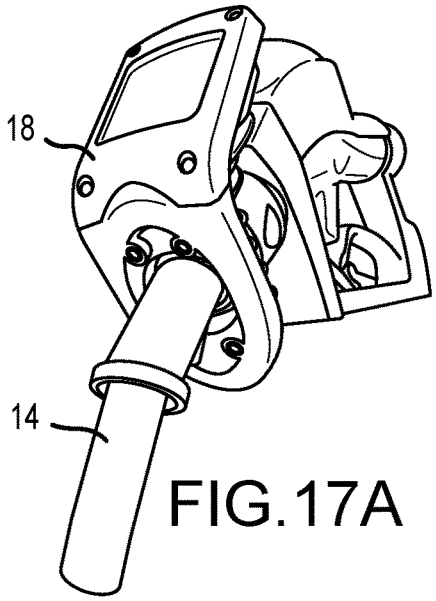
FIG. 17A is a front perspective view of one embodiment of a rotatable RFID housing shown in a first position.
Figure 17B:
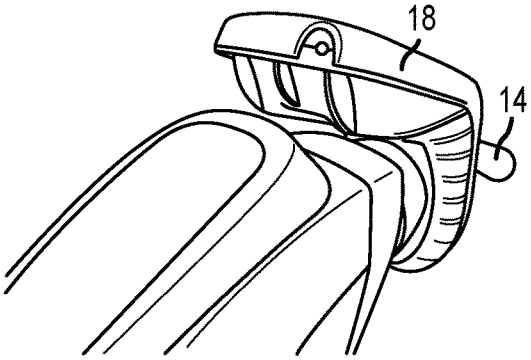
FIG. 17B is a rear perspective view of the embodiment of FIG. 17A.
Figure 18A:
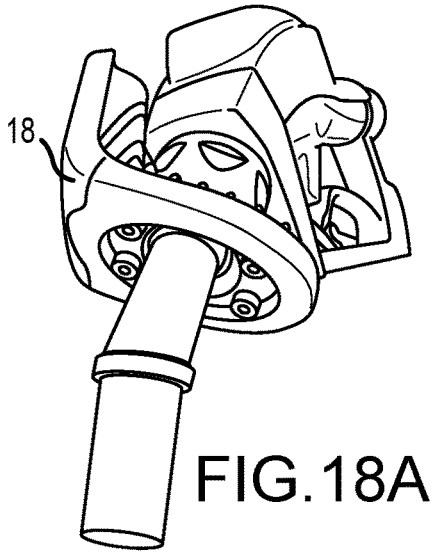
FIG. 18A is a front perspective view of the embodiment of FIG. 17A shown in a second position.
Figure 18B:
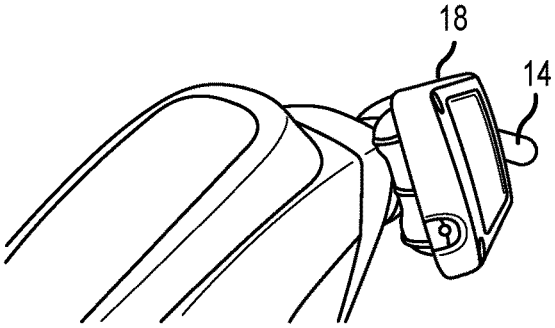
FIG. 18B is a rear perspective view of the embodiment of FIG. 18A.
Figure 19A:
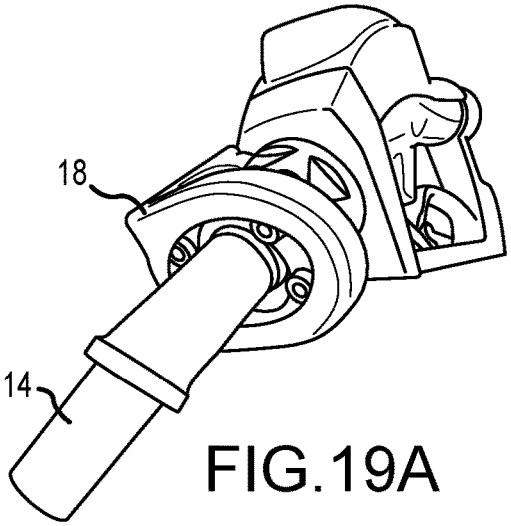
FIG. 19A is a front perspective view of the embodiment of FIG. 17A shown in a third position.
Figure 19B:
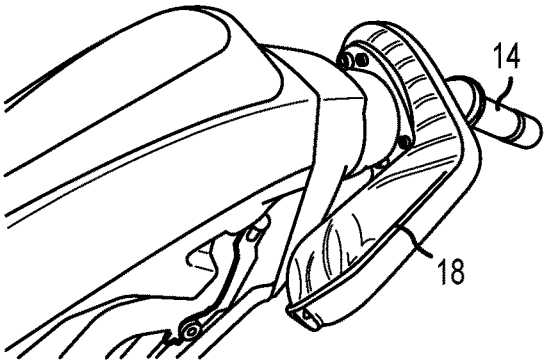
FIG. 19B is a rear perspective view of the embodiment of FIG. 19A.

FIGS. 17A and B illustrate the RFID housing 18 in a position where the rotating bracket assembly is in a vertical orientation (analogous to FIGS. 15A and 16A). FIGS. 18A and B illustrate the RFID housing 18 in a position where the rotating bracket assembly has rotated counterclockwise approximately 45 degrees. FIGS. 19A and B illustrate the RFID housing 18 in a position where the rotating bracket assembly has rotated counterclockwise approximately 90 degrees. It should be further understood that the housing 18 is not limited to the shape or configuration illustrated in the figures, but can be different shapes provided the shape does not interfere with or inhibit rotation of the housing relative to a nozzle 14 engaged with a fuel port in a vehicle.

While various embodiments of the present disclosure have been described in detail, it is apparent that modifications and alterations of those embodiments will occur to those skilled in the art. However, it is to be expressly understood that such modifications and alterations are within the scope and spirit of the present disclosure, as set forth in the following claims. Other modifications or uses for the present disclosure will also occur to those of skill in the art after reading the present disclosure. Such modifications or uses are deemed to be within the scope of the present disclosure.

What is claimed is:

1. A connector for attaching a radio frequency identification (RFID) reader to a fuel dispensing nozzle, the connector comprising:

a collar assembly configured to surround and engage a fuel dispensing nozzle;

a rotating bracket assembly engaged with the collar assembly and configured to rotate relative to the collar assembly; and a housing affixed to the rotating bracket assembly and configured to receive an (RFID) reader;

wherein the housing is repositionable by rotating the rotating bracket assembly relative to the collar assembly and the fuel dispensing nozzle.

2. The connector of claim 1, wherein the rotating bracket assembly comprises:

a plurality of wings, each having an arcuate-shaped inner surface, the plurality of wings disposed adjacent to an outer surface of the collar assembly; and a bearing disposed within at least one of the plurality of wings, the bearing biased to engage the collar assembly at a plurality of discrete locations.

3. The connector of claim 1, wherein the rotating bracket assembly comprises:

a rear plate with a first central aperture, the first central aperture configured to receive the fuel dispensing nozzle; and a plurality of wings affixed to the rear plate, each wing having a curved inner surface configured to interface with the collar assembly;

wherein the plurality of wings are mounted to the rear plate in a uniformly spaced orientation relative to the collar assembly.

4. The connector of claim 3, further comprising a front plate with a second central aperture configured to receive the fuel dispensing nozzle, wherein the plurality of wings are disposed between the front and rear plates.

5. The connector of claim 1, wherein the collar assembly comprises:

an inner collar having a first inner surface configured to contact the fuel dispensing nozzle and a first outer surface; and a bushing affixed to the collar, the bushing having a second outer surface and a second inner surface; the second inner surface in contact with the first outer surface.

6. The connector of claim 5, wherein the inner collar comprises a plurality of arcuate-shaped collar members.

7. The connector of claim 5, wherein the bushing comprises a plurality of arcuate-shaped bushing members.

8. The connector of claim 1, further comprising a stabilizer associated with the collar assembly and the rotating bracket assembly for stabilizing a position of the rotating bracket assembly relative to the collar assembly at a plurality of different positions.

9. The connector of claim 8, wherein the stabilizer comprises:

a plurality of outwardly-facing detents disposed along an outer surface of the collar assembly; and a bearing disposed within the rotating bracket assembly and biased to engage the plurality of outwardly-facing detents.

10. The connector of claim 8, wherein the stabilizer comprises:

a plurality of inwardly-facing detents associated with the rotatable bracket assembly; and a bearing disposed along an outer surface of the collar assembly and biased to engage the plurality of inwardly-facing detents.

11. The connector of claim 8, wherein the stabilizer comprises a first and a second plurality of magnets, the first plurality of magnets disposed in spaced relation around the collar assembly and the second plurality of magnets disposed in spaced relation around the rotating bracket assembly.

12. A connector for attaching a radio frequency identification (RFID) reader to a fuel dispensing nozzle, the connector comprising:

a bracket configured to be affixed to and surround a fuel dispensing nozzle, the bracket configured to rotate relative to the fuel dispensing nozzle; and a housing affixed to the bracket and configured to receive an (RFID) reader;

wherein the housing is repositionable after the connector is securely affixed to the fuel dispensing nozzle, by rotating the bracket relative to the fuel dispensing nozzle.

13. The connector of claim 12, wherein the bracket comprises:

a collar assembly configured to surround and engage the fuel dispensing nozzle; and a rotating bracket assembly engaged with the collar assembly and configured to rotate relative to the collar assembly.

14. The connector of claim 13, wherein the collar assembly comprises:

an inner collar having an inner surface configured to contact with the fuel dispensing nozzle and an outer surface; and a bushing affixed to the collar; the bushing having an outer surface and having an inner surface in contact with the outer surface of the collar.

15. The connector of claim 13, wherein the rotating bracket assembly comprises:

a rear plate with a central aperture, the aperture configured to receive the fuel dispensing nozzle;

a first wing affixed to the rear plate and having a curved inner surface configured to interface with the collar assembly; and a second wing affixed to the rear plate and having a curved inner surface configured to interface with the collar assembly;

wherein the first and second wings are mounted to the rear plate in a spaced orientation such that the first and second wings are positioned on opposite sides of the collar assembly.

16. The connector of claim 13, further comprising a stabilizer associated with the collar assembly and the rotating bracket assembly for stabilizing a position of the rotating bracket assembly relative to the collar assembly at a plurality of different positions.

17. The connector of claim 16, wherein the stabilizer comprises one of:

a plurality of detents disposed in spaced relation on an outer surface of the collar assembly, and at least one bearing disposed within the rotating bracket assembly and biased to engage the detents;

a plurality of detents disposed in spaced relation on a surface of the rotating bracket assembly, and at least one bearing disposed within the collar assembly and biased to engage the detents; or a first and second plurality of magnets, the first plurality of magnets disposed in spaced relation around the collar assembly and the second plurality of magnets disposed in spaced relation around the rotating bracket assembly.

18. A method for enhancing the wireless communication between a radio frequency identification (RFID) tag associated with a vehicle and an RFID reader associated with a fuel delivery system; comprising:

providing a bracket configured to attach to and surround a nozzle of a fuel delivery system, the bracket configured to rotate relative to the nozzle;

securely attaching the bracket to the nozzle of the fuel delivery system;

attaching to the bracket a housing configured to hold an RFID reader; and after securely attaching the bracket to the nozzle, repositioning the housing and at least a portion of the bracket relative to the nozzle.

19. The method of claim 18, wherein the repositioning occurs with the nozzle positioned in the fuel inlet of a vehicle.

20. The method of claim 18, wherein the repositioning includes at least one of a rotational movement and a linear movement of the housing.

* * * * *